US007783054B2

(12) United States Patent
Ringlstetter et al.

(10) Patent No.: US 7,783,054 B2
(45) Date of Patent: Aug. 24, 2010

(54) SYSTEM FOR AURALIZING A LOUDSPEAKER IN A MONITORING ROOM FOR ANY TYPE OF INPUT SIGNALS

(75) Inventors: Jürgen Ringlstetter, Straubing (DE); Leonhard Kreitmeier, Bogen (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 616 days.

(21) Appl. No.: 10/451,613

(22) PCT Filed: Dec. 22, 2000

(86) PCT No.: PCT/EP00/13137

§ 371 (c)(1),
(2), (4) Date: Nov. 4, 2003

(87) PCT Pub. No.: WO02/052895

PCT Pub. Date: Jul. 4, 2002

(65) Prior Publication Data

US 2004/0086131 A1 May 6, 2004

(51) Int. Cl.
*H04R 29/00* (2006.01)

(52) U.S. Cl. ..... 381/59; 381/61; 381/96

(58) Field of Classification Search ..... 381/309–310, 381/59, 58, 26, 61–63, 66, 96; 84/660, 661, 84/697

See application file for complete search history.

(56) References Cited

U.S. PATENT DOCUMENTS 5,187,692 A * 2/1993 Haneda et al. ..... 367/135
5,694,476 A * 12/1997 Klippel ..... 381/96
5,796,843 A * 8/1998 Inanaga et al. ..... 381/17
5,844,816 A 12/1998 Inanaga et al.
5,987,142 A * 11/1999 Courneau et al. ..... 381/17
6,584,204 B1 * 6/2003 Al-Ali et al. ..... 381/96

(Continued)

FOREIGN PATENT DOCUMENTS

GB 2147166 * 5/1985

OTHER PUBLICATIONS

Dalenback et al., "*Audibility of Changes in Geometric Shape Source Directivity and Absorptive Treatment—Experiments in Auralization*," Journal of Audio Engineering Society, New York, vol. 41, No. 11, Nov. 1, 1993, pp. 905-913.

(Continued)

*Primary Examiner*—Vivian Chin
*Assistant Examiner*—Lun-See Lao
(74) *Attorney, Agent, or Firm*—O'Shea Getz P.C.

(57) ABSTRACT

The system comprises a loudspeaker simulation unit for simulating the transmission behavior of the loudspeaker and comprises a room simulation unit, which is connected in outgoing circuit to the loudspeaker simulation unit and which is provided for simulating the transmission behavior of a given monitoring room. The room simulation unit is followed by a presentation unit, which generates an acoustic signal that corresponds to the auditory impression of the loudspeaker in the monitoring room, and/or is followed by an evaluation unit that evaluates the signal, which is provided by the room simulation unit, with regard to at least one psychoacoustic measured quantity, and the evaluation unit outputs a corresponding measurement signal. This measurement signal corresponds to a measurement signal that occurs inside the monitoring room during the presentation of the input signals.

13 Claims, 3 Drawing Sheets

U.S. PATENT DOCUMENTS

| | | | | |
|---|---|---|---|---|
| 6,639,989 | B1 * | 10/2003 | Zacharov et al. | 381/303 |
| 6,718,042 | B1 * | 4/2004 | McGrath | 381/310 |
| 6,895,093 | B1 * | 5/2005 | Ali | 381/66 |
| 6,975,731 | B1 * | 12/2005 | Cohen et al. | 381/74 |
| 7,024,259 | B1 * | 4/2006 | Sporer et al. | 700/94 |
| 7,095,860 | B1 * | 8/2006 | Kemp | 381/61 |
| 7,206,419 | B1 * | 4/2007 | Poletti | 381/98 |
| 2002/0067835 | A1 * | 6/2002 | Vatter | 381/58 |

OTHER PUBLICATIONS

Beerends et al., "*A Perceptual Audio Quality Measure Based on a Psychoacoustic Sound Representation*," Journal of Audio Engineering Society, New York, vol. 40, No. 12, Dec. 1, 1992, pp. 963-978.

Hidaki, "*Sound-Field Simulator for Room Acoustic Design and Assessment—Introduction of Wave-Theoretical Treatment to Synthesized Sound*," Journal of Audio Engineering Society, New York, vol. 41, No. 11, Nov. 1, 1993, pp. 914-919.

Ahnert et al., "*EARS Auralization Software*," Journal of Audio Engineering Society, New York, vol. 41, No. 11, Nov. 1, 1993, pp. 894-904.

Granier, "*Experimental Auralization of Car Audio Installations*," Journal of Audio Engineering Society, New York, vol. 44, No. 10, Oct. 1, 1996, pp. 835-849.

Kleiner et al., "*Auralization—An Overview*," Journal of Audio Engineering Society, New York, vol. 41, No. 11, Nov. 1, 1993, pp. 861-874.

Mochimaru, "*A Study of the Practicality and Accuracy of Impulse Response Calculations for the Auralization of Sound System Design*," Journal of Audio Engineering Society, New York, vol. 41, No. 11, Nov. 1, 1993, pp. 881-892.

Korenaga et al., "*A Sound-Field Simulation System and Its Application to a Seat-Selection System*," Journal of Audio Engineering Society, New York, vol. 41, No. 11, Nov. 1, 1993, pp. 920-930.

* cited by examiner

SYSTEM FOR AURALIZING A LOUDSPEAKER IN A MONITORING ROOM FOR ANY TYPE OF INPUT SIGNALS

CROSS REFERENCE TO RELATED APPLICATIONS

This application is for entry into the U.S. national phase under §371 for International Application No. PCT/EP00/13137 having an international filing date of Dec. 22, 2000, and from which priority is claimed under all applicable sections of Title 35 of the United States Code including, but not limited to, Sections 120, 363 and 365(c).

TECHNICAL FIELD

A system for auralizing a loudspeaker in a monitoring room for any type of input signals.

The invention concerns a system for auralizing a given loudspeaker in a given monitoring room for any type of input signals.

BACKGROUND OF THE INVENTION

Despite numerous objective evaluation criteria for acoustic systems, such as for example frequency response, distortion factor, etc., a comprehensive evaluation also requires above all psychoacoustic criteria, wherein the full auditory impression of listeners, which is difficult to measure, plays a particularly significant role. Determining a meaningful average auditory impression requires several different listeners who form their opinion under mostly identical conditions. To that end the same sounds are preferably offered in succession to the listeners in the same place, which they can then evaluate in accordance with corresponding subjective criteria. A considerable expense is already required to carry out such an evaluation.

In addition, this expense is multiplied if, as is often the case, not only one loudspeaker system is to be tested in a monitoring room but several different loudspeaker systems and/or different monitoring rooms are to be tested. This becomes even more difficult and considerably more expensive if the loudspeaker systems and/or the different monitoring rooms must be interchanged. For example the evaluation of loudspeaker systems in vehicles is difficult because the testers in each seat can only be questioned individually, and as a rule changes in the loudspeaker systems and to the interior space involve construction and are time consuming. Depending on the situation, the testing in vehicles usually takes place at the end of the development time, thus at a time when only a small number of interior spaces can be provided and the available time for acoustic testing is very short.

SUMMARY OF THE INVENTION

It is therefore the object of the invention to present a system wherein at least one given loudspeaker in at least one given monitoring room can be tested with any type of input signals at a clearly lower cost.

The invention achieves this object with a system for auralizing a given loudspeaker in a given monitoring room with any type of input signals, with a loudspeaker simulation unit comprising a first transmission function, which describes at least partially the transmission behavior of the loudspeaker, a room simulation unit connected downstream thereof, comprising a first transmission function which describes at least partially the transmission behavior of the given monitoring room and a presentation unit which is connected downstream of the room simulation unit and produces an acoustic signal that corresponds to the auditory impression of the loudspeaker in the monitoring room.

The invention also achieves this result with a system for auralizing a given loudspeaker in a given monitoring room with any type of input signals, with a loudspeaker simulation unit comprising a first transmission function, which describes at least partially the transmission behavior of the loudspeaker, a room simulation unit connected downstream thereof, comprising a second transmission function which describes at least partially the transmission behavior of a given monitoring room, and an evaluation unit which is connected downstream of the room simulation unit and evaluates the signal provided by the latter in regard to at least one psychoacoustic measured value, and emits a corresponding signal which corresponds to a measurement signal that occurs in the monitoring room when the input signals are presented.

The invention provides for different simulation units, particularly in connection with different acoustic measurement and analysis systems for the integral auralization of loudspeaker and room characteristics. In this case the transmission path of the electrical signal is auralized from the loudspeaker input to the tone signal in the listener's ear. The system of the invention is especially suitable for simulation of vehicle interiors equipped with one or several loudspeakers.

The advantage of the invention is that the level-dependent transmission functions of the individual loudspeaker (as well as its large signal behavior), and also the room transmission functions from the individual loudspeaker to the left and the right ear, including the loudspeaker's spatial radiation characteristics, take into consideration both the room transmission function with attenuations and reflections as well as the spatial sound distribution. This also makes it possible to alter individual parts of the transmission chain for the purpose of its optimization.

The system of the invention creates a virtual vehicle interior that is equipped with virtual loudspeakers to be tested. This allows a clear increase in the time during which a monitoring room, particularly the interior of a vehicle, must be available for the tuning of its sound system. Most of the tuning takes place in the virtual vehicle.

This is achieved with a loudspeaker simulation unit containing a first transmission function which at least partly describes the loudspeaker's transmission behavior, and a downstream connected room simulation unit containing a second transmission function which at least partly describes the transmission behavior of the given monitoring room. In addition another unit is provided which, either by means of a presentation unit that is connected downstream of the room simulation unit and generates an acoustic signal that corresponds to the auditory impression of the loudspeaker in the monitoring room, or by means of an evaluation unit connected downstream of the room simulation unit, which evaluates the signal generated by the room simulation unit with respect to at least one psychoacoustic measured quantity, and emits a corresponding measurement signal, where this measurement signal corresponds to a measurement signal that occurs when the input signals are presented in the monitoring room.

The transmission path between the loudspeaker input and the listener's hearing can thus be auralized, and a corresponding psychoacoustic evaluation unit can be provided in addition to or instead of a listener, in order to objectify any subjective psychoacoustic criteria.

The presentation unit preferably includes a headset and an amplifier, which are coupled so that the signal generated in the headset by the room simulation unit produces an auditory impression that corresponds to the auditory impression created by the loudspeaker in the monitoring room. The presentation unit is therefore normalized so that any type of preceding transmission functions, namely the loudspeaker and room transmission function, can no longer be influenced by the presentation unit. The presentation via the headset has the advantage that changes in the transmission behavior of the presentation unit, for example due to a changing distance between the signal source and the ear, such as occurs perhaps with a loudspeaker presentation instead of a headset presentation, are excluded.

The headset can preferably be coupled to a position sensing unit which determines its relative position with respect to a given zero position, and as a function of this position changes the transmission behavior of the room simulation unit so that the now created auditory impression corresponds to the auditory impression in the corresponding listening position during a loudspeaker presentation in the monitoring room. This creates a more realistic auditory impression since changes in the transmission function caused by changes in the head position are also taken into consideration.

As an alternative, the evaluation unit can at least evaluate the loudness and/or the roughness and/or the sharpness and/or the critical band rate and/or the acoustical liveness as a psychoacoustic measured quantity. This allows psychoacoustic impressions to be objectively obtained and comparatively evaluated.

The loudspeaker simulation unit is preferably designed to simulate at least the driving force and/or the stiffness of the diaphragm suspension and/or the voice coil inductance. These few magnitudes are already able to very clearly simulate the behavior of a given loudspeaker.

In addition to a single one, several loudspeaker simulation units can also be provided; they are interconnected in parallel on the input side and their output signals can be additively linked to each other for example. In this case each individual loudspeaker simulation unit simulates one loudspeaker in a system. For example a single loudspeaker simulation unit can be respectively used for the left and the right stereo channel and/or for the high, middle and bass response. In this way loudspeaker arrangements comprising several loudspeakers can simulate virtual monaural or stereophonic reproduction for example.

For stereophonic or quadrophonic reproduction the loudspeakers are combined into two groups for example, i.e. two groups for stereophonic and four for quadrophonic reproduction, where the respective loudspeakers within a group are additively linked to each other. In this case the respective loudspeaker simulation units correspond to the loudspeaker.

An input selector unit can be connected in series with the loudspeaker simulation unit(s), and the different signal sources (such as for example digital or analog sources) can be connected thereto. They can then be selected by means of a selection signal and switched over to the loudspeaker simulation unit(s).

The input signals are preferably provided by a final stage designed to control the respective loudspeaker. The final stage then terminates in an impedance, whose behavior over the entire control range is essentially the same as the impedance course of the respective loudspeaker. In this way the auralization also includes the amplifier provided for control of the loudspeaker.

In this case a first and a second transmission function can be derived from loudspeaker or room parameters, which were determined by calculation and/or measurement.

Finally loudspeaker parameters can also be provided from which the directional pattern of the respective loudspeaker can be determined, where these parameters are supplied to the room simulation unit and influence the second transmission function. In this way loudspeakers with highly different directional patterns can also be used without distortion of the auditory impression.

BRIEF DESCRIPTION OF THE DRAWINGS

The invention will be explained in greater detail in the following by means of the embodiments illustrated by the figures of the drawings, where.

DETAILED DESCRIPTION

Figure 1:
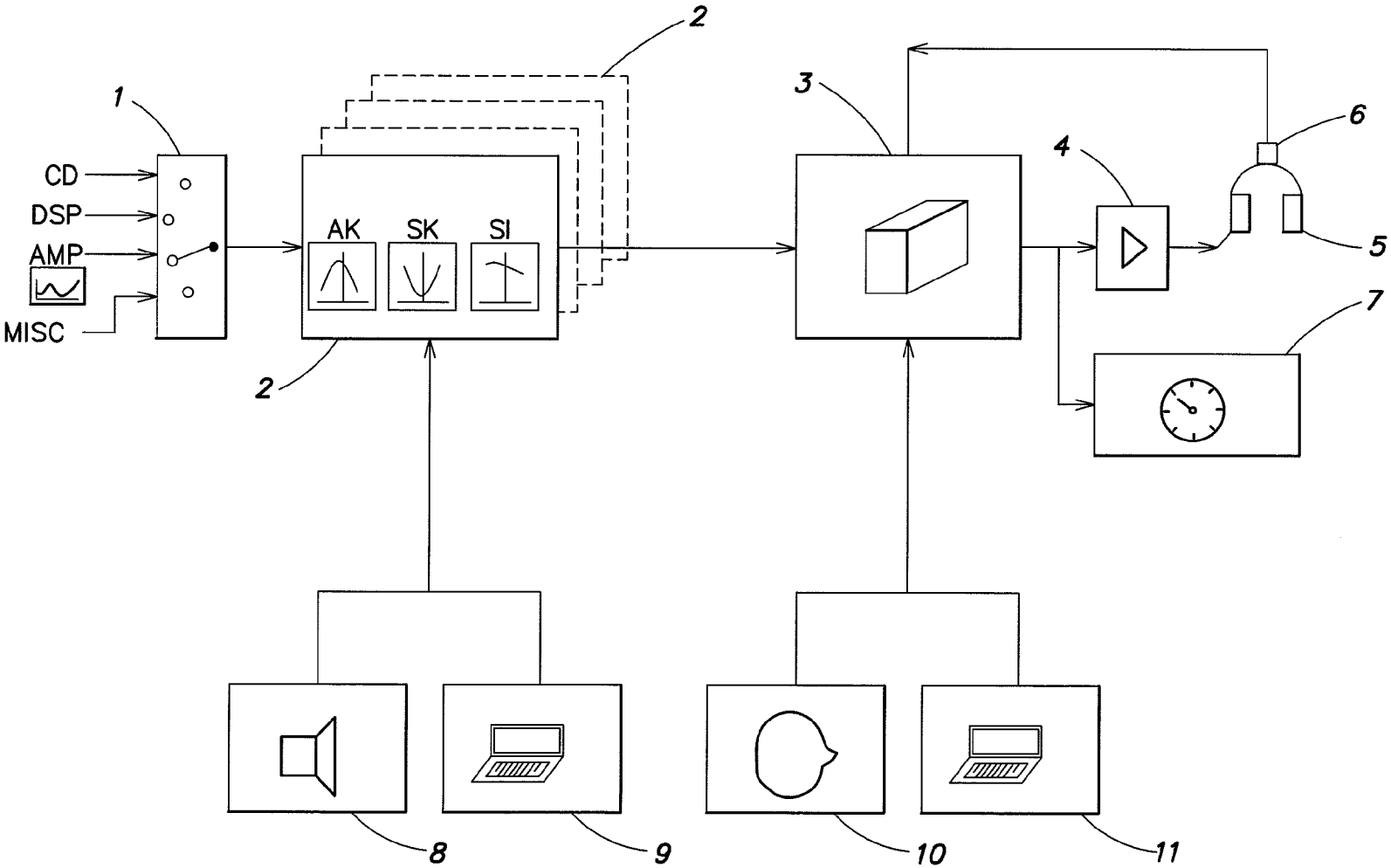
FIG. 1 is a first general embodiment of a system according to the invention.

The system shown in FIG. 1 comprises an input selector unit 1 for connecting four signal sources for example, one each of which respectively is a compact disc player CD, a digital signal processor DSP, a power amplifier AMP and any other miscellaneous source MISC. The CD-player CD and the digital signal processor DSP produce digital audio signals, while the signals from the power amplifier AMP and the signals from the other source MISC are analog. The input selector unit converts the individual signals accordingly, depending on whether the output signal is analog or digital.

The input for connecting the power amplifier AMP is especially designed so that it reproduces the impedance (i.e. and also the behavior) of the respective loudspeaker to be simulated. This can be achieved for example with corresponding, particularly nonlinear filters.

The input selector unit 1 is followed by one or several loudspeaker simulation units 2 connected in parallel on the input side (the embodiment has a total of four individual loudspeakers) which depending on the arrangement receive a digital or an analog signal from the input selector unit 1. The four loudspeaker simulation units 2 are divided into two groups, each having for example a simulated high tone and a simulated bass loudspeaker. The loudspeaker simulation unit reproduces the driving force factor AK and/or the stiffness SK of the diaphragm suspension and/or the voice coil inductance SI for example.

The output signals (digital or analog) from the individual loudspeaker simulation units are (preferably additively) superimposed on each other and then supplied to a room simulation unit 3. The room simulation unit reproduces the transmission function between the loudspeaker and the listener's ear, where a stereo amplifier 4 with an attached headset 5 are connected to the room simulation unit 3. The amplifier 4 and the headset 5 are tuned to the room simulation unit so that the transmission path between the loudspeaker and the listener's ear is reproduced by the room simulation unit 3, the amplifier 4 and the headset 5.

The headset 5 in the embodiment is especially coupled to a position sensing unit 6 which, starting from a zero position, records the turns of the head and feeds them back to the room simulation unit 3. The latter then changes the transmission function so that it corresponds to an actual head turning in the real monitoring room.

In addition to or instead of the auralization via the headset and the listener, the latter's subjective impression can also be simulated in that a psychoacoustic evaluation unit 7, which is connected downstream of the room simulation unit 3, evaluates the signal produced by the latter with regard to at least one psychoacoustic measured quantity.

The transmission functions for the loudspeaker simulation units 2 and the room simulation unit 3 are either provided by corresponding measurement units 8 or 10 or by special calculation units 9 or 11, and are loaded for example as parameters or as a corresponding microprogram into the respective units. It is useful if the measurement units 8 or 10 and the calculation units 9 or 11 are integrated into the respective simulation units, namely the loudspeaker simulation units 2 and the room simulation unit 3.

So-called loudspeaker distortion analyzers, as distributed for example by Klippel GmbH can be used as loudspeaker simulation units. A single measuring device can both measure and determine the nonlinear properties of a given dynamic loudspeaker, and by means of an auralization function also the audibility of the distortions resulting from these measured nonlinearities. The control magnitudes can be for example the large signal behavior of the loudspeaker to be reproduced by the loudspeaker simulation unit 2, and/or the room response (including the loudspeaker's radiation characteristics), the total room response as well as the directional pattern of the microphone system (for example a dummy head).

The nonlinear properties can be determined as follows. First an output signal is produced to excite the loudspeaker to be measured, which can be a digitally generated noise for example. This signal is used to drive the loudspeaker being simulated, and to that end predetermined magnitudes at the loudspeaker's electrical input are evaluated. For example the current flowing through the loudspeaker coil, and the voltage at the loudspeaker coil are measured. In addition the deflection of the loudspeaker diaphragm is determined for example with a laser gap sensor whose signal is also available in electrical form.

These input magnitudes are then used to measure predetermined small signal parameters as well as predetermined large signal parameters of the loudspeaker. As a function of the deflection, the large signal parameters produce the same magnitudes as indicated by the small signal parameters. Furthermore the loudspeaker's efficiency is determined, which in addition depends on the effective diaphragm area, the compression and the thermal coil and magnet system parameters. Control data are also finally determined, which comprise for example the peak values of the deflection during the full time of measurement, the current, voltage and output during the time of measurement, and the coil temperature during the time of measurement.

For the measurement itself, the information needed to determine the loudspeaker's characteristics is extracted from the electrical noise signal that is available at the loudspeaker terminals, and from the laser gap sensor which contains information about the diaphragm movement. Determining the efficiency also requires the effective diaphragm area, which can be measured and entered manually for example.

The noise signal is now supplied for amplification to the final stage which preferably also has other uses, and from there the amplified signal is conducted to the measurement unit 8, which finally transmits it to the loudspeaker. The amplified signal is returned to the measurement unit 8 so that it can evaluate the signal's current and voltage that are actually supplied to the loudspeaker.

The noise signal level is low at the beginning of the measurement since the small signal parameters must yet be determined. To determine the large signal parameters the level of the noise signal is then steadily increased until a specified upper limit has been reached.

The primary magnitudes from which most of the remaining parameters can be derived are the force factor of the diaphragm deflection AK, the coil inductance SI of the diaphragm deflection and the stiffness SK of the diaphragm suspension.

These three characteristics essentially describe the causes of the nonlinear distortions which are a condition of the drive and the suspension. The loudspeaker can be comprehensively described in conjunction with the also determined direct current resistance, the mechanical attenuation and moving mass values.

The thermal resistance and the thermal capacitance of the coil and magnet system can also be obtained and used to describe heat-conditioned effects.

A loudspeaker is first measured for the auralization, or its measured data which had been determined or calculated earlier are downloaded from the data bank into a digital signal processor for example. For the auralization any tone signal is then fed to the loudspeaker simulation unit 2. This signal is then distorted for example by a digital signal processor with appropriate software in accordance with the modeled loudspeaker.

The digital signal processor implements an equivalent electrical diagram of a loudspeaker (software). This equivalent electrical diagram models the loudspeaker. To adapt the model to the loudspeaker, the same signal as sent to the loudspeaker to be simulated is sent to the model. The measured current flowing through the loudspeaker and the current that is read from the equivalent electrical diagram are compared with each other. The parameters of the equivalent electrical diagram are optimized until the difference between the two currents reaches a minimum. The parameters of the equivalent electrical diagram are determined as a function of control. By comparing the currents all loudspeaker parameters can be relatively obtained. The information of the diaphragm movement which is provided by the gap sensor, is used for conversion into absolute values.

Figure 2:
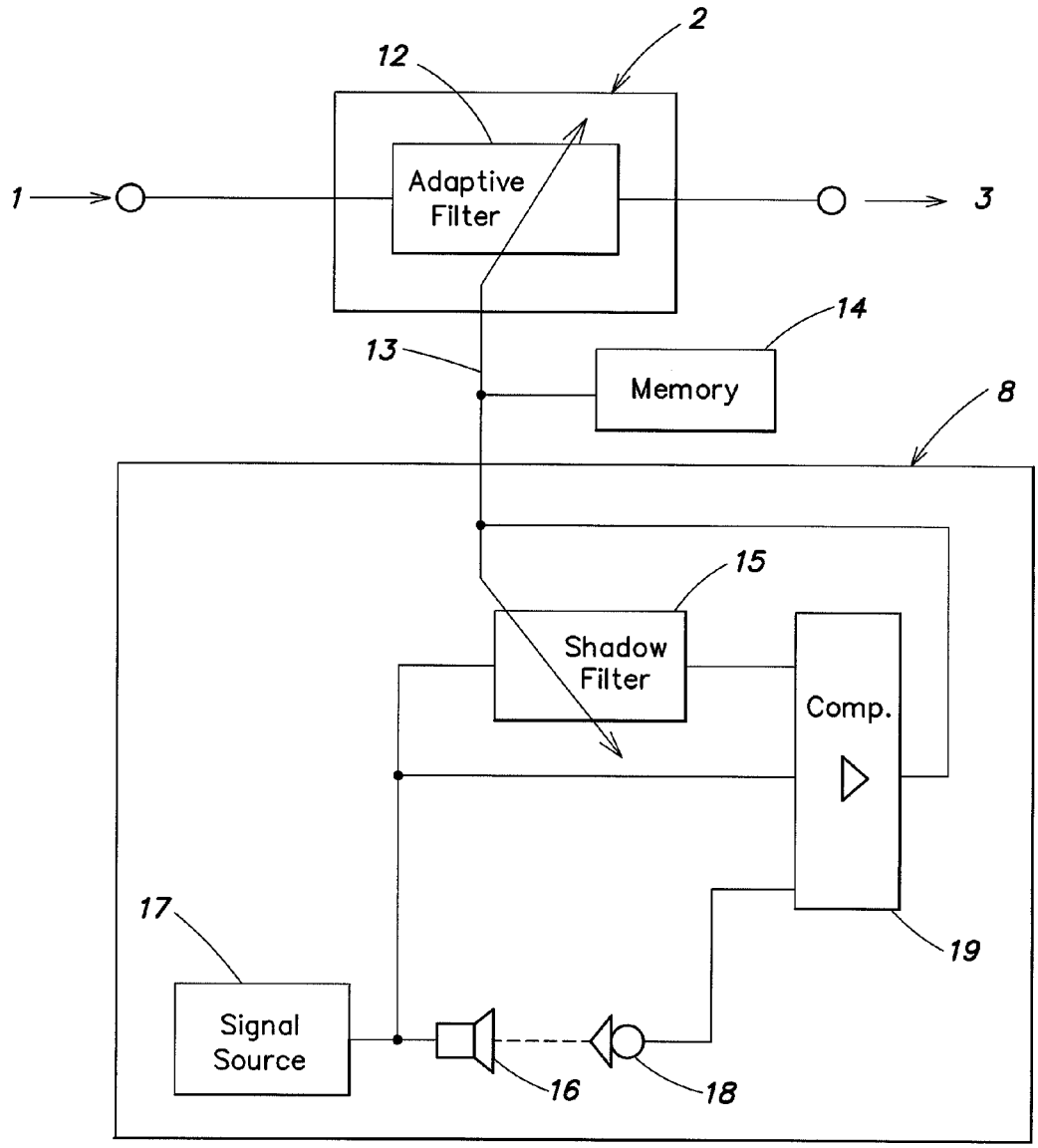
FIG. 2 is a configuration of a loudspeaker simulation unit for use with a system according to FIG. 1.

In this way the loudspeaker simulation units 2 respectively represent nonlinear (analog or digital) filters, whose coefficients and thus their transmission behavior can be altered by means of the externally transmitted loudspeaker parameters. FIG. 2 illustrates a configuration of a simulation unit 2 in connection with a measurement unit 8.

The loudspeaker simulation unit 2 comprises an adaptive filter 12 which receives a set of coefficients 13. The latter can either be obtained from a memory 14, or it can be directly provided by the measuring unit 8. In this case the memory 14 contains sets of coefficients which had already been determined earlier.

A shadow filter 15 that is constructed identical to filter 12 is provided in the measurement unit 8 to determine the sets of coefficients. Instead of the shadow filter 15, the filter 12 itself could therefore also be used in the same manner. The filter 15 as well as a loudspeaker 16 to be measured are equally controlled by a signal source 17. The diaphragm movement of loudspeaker 16 is determined by a gap sensor 18 (for example a laser gap sensor) and supplied to a comparator unit 19. In addition the latter receives the output signal of the signal source 17 and the output signal of the filter 15. Starting with the signal from signal source 17, the output signal of filter 15 and the signal provided by the gap sensor 18 are compared with each other, and as a function of this comparison the filter 15 is adjusted to minimize the differences between the two signals. The comparator unit 19 for example evaluates the force factor of the diaphragm deflection, the coil inductance of the diaphragm deflection, the stiffness of the diaphragm deflection, the mechanical attenuation, the thermal resistance and the thermal capacitance of the coil and the magnet system. The filter coefficients determined by the comparator unit 19 can then be sent directly to the filter 12, or they can be stored in the memory 14 for later use. Thus either the coefficients can now be sent to the loudspeaker simulation unit 2 (FIG. 3), or the parameters from which the loudspeaker simulation unit 2 itself can calculate the coefficients (FIG. 2).

In addition to the loudspeaker simulation unit in connection with a measurement unit 8 shown as an example in FIG. 2, other simulation and measurement units or parts thereof can be used either unchanged or adapted, as described in a different context for example by U.S. Pat. Nos. 5,815,585, 5,694,476 and 5,438,625. With a corresponding adaptation, the test procedures cited therein can also be applied to the present invention. In that case the adaptive filter and if necessary the pertinent shadow filter must be designed accordingly. The content of the cited patents is therefore incorporated by reference in the disclosure of the present application.

So-called binaural room scanning processors, as introduced for example by Studer AG, are especially used as the room simulation unit 3. The simulation unit is used to auralize the acoustic properties of the monitoring room by means of standard loudspeakers installed therein.

The tone signal received by the listener's ear from one or several given loudspeakers in a given monitoring room, is not only influenced by the properties of the loudspeaker but also by the acoustic properties of the environment. Here the sound is not only received by the listener via a direct path, but additionally via reflections in which bending and absorption effects take place. The arrangement of the room also influences the tone signal in the ear. These effects are a function of the acoustic properties of the room, as well as the position, the orientation and the directional pattern of the sound source (loudspeaker) and the receiver (listener).

Finally the tonal assessment of a loudspeaker or a loudspeaker system is therefore only possible if it takes place in the spatial environment and with the installation for which the loudspeaker system is intended. If this room is not always available with the loudspeakers in position, it may be useful to auralize its acoustic transmission properties. This makes it possible to hear a tone signal as it would be heard in the actual room, for example via a headset (or as an alternative via a corresponding near field loudspeaker system).

To determine the rooms transmission function, a broadband test signal is sent to the loudspeakers to be measured, and is recorded by a dummy head. The recorded test signal is compared to the original test signal with the help of digital signal processors for example, and the transmission function is calculated from the difference. In this case the resulting transmission function depends on the position, orientation, directional pattern and the electroacoustic properties of the loudspeaker(s). There is furthermore a dependence on the geometry, the reflective properties and the attenuation characteristics of the room, as well as on the position, the orientation and the directional pattern of the receiver.

Once the respective transmission function has been determined it can be implemented for example in a digital filter and any signals can be reproduced via the filter. The thus altered signal can then be reproduced by a headset for example. The monitored signal then contains at least the essential information about the particular monitoring room.

A further development of the invention is the determination of the transmission function not only for a single orientation of the dummy head, but for example for all horizontal orientations e.g. from +42° to −42° in 6° intervals around a predetermined 0° central position. The results in this case are 15 individual transmission functions for each of the two stereo channels.

The reproduction in this embodiment takes place via a headset 5. The stored transmission functions are called up by the position sensing unit 6, for example a shaft rotation encoder which is connected to the headsets 5, as a function of the momentary horizontal orientation of the headset 5. To prevent disturbances from the sudden switch-over between the angular transmission functions due to a rotation of the head, the transmission function for the angles is interpolated among the recorded transmission functions. This procedure allows the sound impression monitored via the headset to remain stable in one position, even when the head is turned, and not to rotate with it as would otherwise be the case with a headset reproduction. Vertical movements can be dealt with accordingly.

Figure 3:
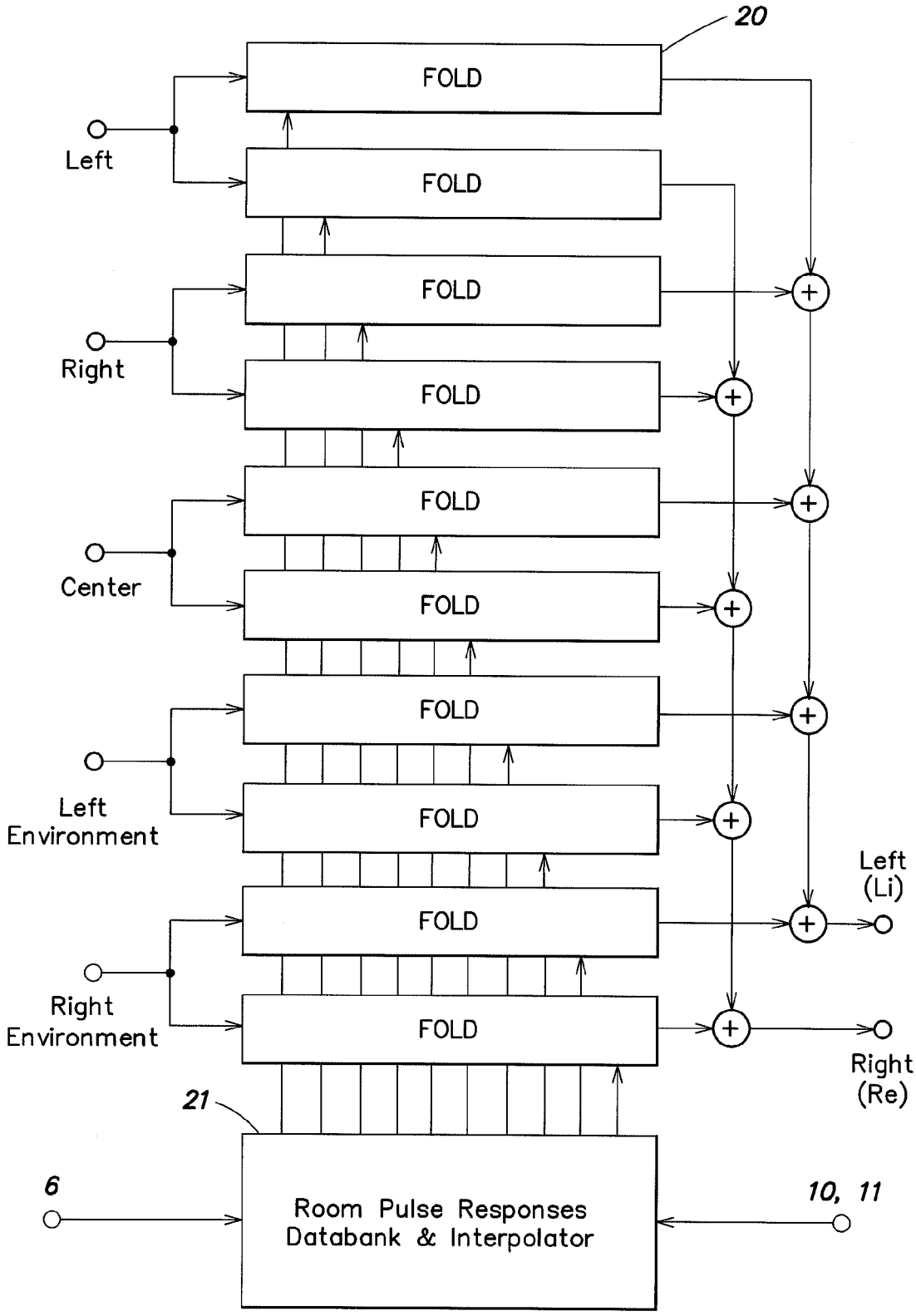
FIG. 3 is a room simulation unit for use with a system according to FIG. 1.

FIG. 3 illustrates an example of a room simulation unit 3. It comprises for example ten individual folding units 20, each of which folds (combines, e.g., convolutes) an incoming signal with a pair of binaural room pulse responses interpolated with reference to the head position. It begins for example with five individual signal source positions such as e.g. left, right, center, left environment and right environment. Each of these incoming signals is then fed to two individual folding units 20, where the output side of one is connected to the left channel li, and the other to the right channel re of the output designed for control of the headset 5. The individual room pulse responses are provided by the control unit 21, which takes the room pulse responses that were recorded for example by a dummy head under the existing conditions, and stores them in a data bank which interpolates the transmission functions located between the stored data bases and, depending on a position signal from the position sensing unit 6, provides the corresponding room pulse responses and transmits them to the folding units 20.

On the one hand the incoming left, right, center, left environment and right environment signals allow to arrange the virtual position of the virtual sound sources in the virtual monitoring room, and if the radiation characteristics of the loudspeakers being used are also available (as is the case with the embodiment in FIG. 1), the measurement unit 8 can also calculate by means of the data how a loudspeaker placed in a central position can also affect the neighboring positions. In this way different signal source positions are interlinked with different listening positions via corresponding room pulse responses, and by means of an additive link are sent to two monitoring channels li, re for control of the headset 5.

As already illustrated in FIG. 1, a psychoacoustic measurement unit 7 can also be provided instead of the output via the headset 5, which permits to objectify the auditory impression by means of significant psychoacoustic measured values. This installation can be used additionally or alternately for monitoring. In this case loudness, roughness, sharpness, critical band rate, acoustical liveness, etc. can be used as the characteristic psychoacoustic measured magnitudes. The respective definitions and possibilities of the measurement can be found for example in the book "Psychoakustic" by Eberhard Zwicker, Springer Publishers, 1982.

Thus as was shown, a system according to the invention allows the auralization of a loudspeaker in conjunction with the acoustic properties of the monitoring room and the path to the listener. Essential to the invention are modeled transmission functions for loudspeakers and monitoring room. The modeling can be based on a measurement, or be provided by a simulation program (for example CAPA for loudspeakers and ANSYS, RAYNOISE, SYSNOISE for monitoring rooms). If all the transmission functions are available, namely for both loudspeakers as well as monitoring room, any tone signal can be reproduced with this system and the specific transmission function of the entire desired monitoring chain can be taken into consideration.

Modeling the loudspeaker requires the most important loudspeaker transmission functions to be obtained in accordance with their dependence on control. They can also be calculated as an alternative. If the transmission function of the loudspeaker is loaded into the loudspeaker simulation unit, the latter alters a tone signal in the same way as the original loudspeaker would.

A corresponding number of loudspeaker simulation units is required if several loudspeakers are to be auralized at the same time.

A selector unit makes it possible to connect different signal sources to the signal input of the loudspeaker simulation unit(s). A special feature is the input connection of a power amplifier provided to control the original loudspeaker. This specially constructed input is designed to simulate the impedance of the modeled loudspeaker. Besides that any other digital signal sources with different data formats can also be connected, as well as analog signal sources.

Two room transmission functions per loudspeaker (left ear/right ear) must be considered for modeling the room transmission function which describes the path between the loudspeaker and the ear. In this case the resulting room transmission function depends on the position, orientation and directional pattern of the sound source, on geometry, reflective properties and the attenuation characteristics of the room as well as on the position, orientation and directional pattern of the receiver. The transmission function resulting therefrom can be measured for example by a special measurement unit, for which essentially a dummy head or a similar device is used. As an alternative however, these transmission functions can also be calculated with simulation programs. In that case the room data sets are read into the room simulation unit in a corresponding manner.

A special design not only measures and reproduces the transmission functions for a head orientation, but also for the range of a natural horizontally rotating movement of the head on both sides. A headset which is equipped with a rotation encoder is provided for the auralization. This rotation encoder signals to the room simulation unit which transmission function should be switched on, in accordance with the momentary angle of rotation of the head. The result is a considerable improvement of the reproduction of the spatial acoustic effect.

Finally several room simulation units can be switched in parallel on the input side, where all room simulation units preferably operate at the same room parameters. In that case one and the same monitoring position (for example the car driver position) can be simultaneously monitored and evaluated by several testers. In addition running noises can also be included for a realistic evaluation of vehicle interiors.

The invention claimed is:

1. A system for auralizing a given loudspeaker in a given monitoring room with one of a plurality of input signals, wherein the loudspeaker has a non-linear large signal behaviour, the system for auralizing comprising:

a loudspeaker simulation unit that receives and filters the one of a plurality of input signals, comprising a first transmission function that describes at least partially the transmission behaviour of the loudspeaker including the non-linear large signal behaviour of the loudspeaker, including loudspeaker coil and loudspeaker diaphragm characteristics of the loudspeaker, where the loudspeaker simulation unit provides an loudspeaker simulation output signal;

a room simulation unit that receives the loudspeaker simulation output signal, the room simulation unit comprising a second transmission function that describes at least partially the transmission behaviour of the given monitoring room, including a radiation characteristic of the loudspeaker, and provides a room simulation output signal; and a presentation unit that receives the room simulation output signal and produces an acoustic signal that corresponds to the auditory impression of the loudspeaker in the monitoring room.

2. A system as claimed in claim 1, wherein the presentation unit comprises a headset and an amplifier that are coupled so that the signal produced in the headset by the room simulation unit produces an auditory impression which corresponds to the auditory impression created by the loudspeaker in the monitoring room.

3. A system as claimed in claim 2, wherein the headset is coupled to a position sensing unit which determines the relative position of the headset in regard to a given zero position, and changes the transmission behaviour of the room simulation unit as a function of this position so that the thus produced auditory impression corresponds to the auditory impression created by the loudspeaker in the respective auditory position of the monitoring room.

4. A system for auralizing a loudspeaker having a non-linear large signal behaviour, in a monitoring room with one of a plurality of input signals, the system comprising:

a loudspeaker simulation unit that receives one of the plurality of input signals, comprising a first transmission function, which describes at least partially the transmission behaviour of the loudspeaker, including a non-linear large signal behaviour of the loudspeaker including loudspeaker coil and loudspeaker diaphragm characteristics of the loudspeaker, and provides a loudspeaker simulation unit output signal;

a room simulation unit that receives the loudspeaker simulation output signal, and comprises a second transmission function that describes transmission behaviour of the monitoring room, including a radiation characteristic of the loudspeaker and provides a room simulation output signal, and an evaluation unit that receives and evaluates the room simulation output signal in regard to at least one psychoacoustic measured value, and emits a corresponding signal which corresponds to a measurement signal that occurs in the monitoring room when the input signals are presented.

5. A system as claimed in claim 1, wherein the loudspeaker simulation unit simulates at least one of the following characteristics of the loudspeaker: driving force, stiffness of the diaphragm suspension, voice coil inductance.

6. A system as claimed in claim 1, wherein several loudspeaker simulation units are provided that have their respective inputs interconnected in parallel, and whose output signals are additively interlinked, where each loudspeaker simulation unit simulates one loudspeaker of a system.

7. A system as claimed in claim 6, wherein the loudspeaker simulation units are combined into at least two groups and are additively interlinked within each group.

8. A system as claimed in claim 1, wherein the loudspeaker simulation unit is preceded by an input selector unit having an output for selectively presenting different signal sources to the input of loudspeaker simulation unit.

9. A system as claimed in claim 1, wherein a final stage is provided as the signal source for control of the respective loudspeaker, where the final stage is terminated by impedances whose behaviour over an entire control range essentially equals that of the impedance of loudspeaker.

10. A system as claimed in claim 1, wherein the first transmission function is derived from loudspeaker parameters that are determined by calculation and/or measurement.

11. A system as claimed in claim 1, wherein the second transmission function is derived from room parameters that are determined by calculation and/or measurement.

12. A system as claimed in claim 11, that also has loudspeaker parameters provided from which the directional pattern of the respective loudspeaker can be determined, where these parameters are supplied to the room simulation unit which influences the second transmission function.

13. A system as claimed in claim 4, wherein the evaluation unit evaluates the signal provided by the room simulation unit for at least one of the following psychoacoustic measured values: loudness, roughness, sharpness, critical band rate, and acoustical liveness as a psychoacoustic measured magnitude.

* * * * *